US009022125B2

(12) United States Patent
Weir et al.

(10) Patent No.: US 9,022,125 B2
(45) Date of Patent: May 5, 2015

(54) MARINE RISER WITH SIDE TENSION MEMBERS

(71) Applicant: National Oilwell Varco, L.P., Houston, TX (US)

(72) Inventors: James William Weir, Houston, TX (US); Dean Allen Bennett, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 72 days.

(21) Appl. No.: 13/690,543

(22) Filed: Nov. 30, 2012

(65) Prior Publication Data

US 2014/0151058 A1 Jun. 5, 2014

(51) Int. Cl.
*E21B 17/01* (2006.01)
*E21B 17/02* (2006.01)
*E21B 17/08* (2006.01)

(52) U.S. Cl.
CPC ..... *E21B 17/01* (2013.01); *E21B 17/085* (2013.01)

(58) Field of Classification Search
CPC ..... E21B 17/01; E21B 17/012; E21B 17/085; E21B 19/004
USPC ..... 166/355, 350, 367; 138/111, 155; 285/363, 374, 399, 405; 405/169, 170, 405/224.2
See application file for complete search history.

(56) References Cited

U.S. PATENT DOCUMENTS

| | | | | |
|---|---|---|---|---|
| 3,858,401 | A | 1/1975 | Watkins | |
| 3,955,621 | A * | 5/1976 | Webb | 166/355 |
| 4,043,575 | A | 8/1977 | Roth | |
| 4,124,231 | A | 11/1978 | Ahlstone | |
| 4,124,321 | A | 11/1978 | Hutchins | |
| 4,265,470 | A | 5/1981 | Danner | |
| 4,280,719 | A | 7/1981 | Daniel et al. | |
| 4,330,140 | A * | 5/1982 | Hampton | 285/39 |
| 4,332,509 | A | 6/1982 | Reynard et al. | |
| 4,436,157 | A | 3/1984 | Brooks | |
| 4,496,172 | A | 1/1985 | Walker | |
| 4,496,173 | A * | 1/1985 | Roche et al. | 285/24 |
| 4,550,936 | A * | 11/1985 | Haeber et al. | 285/26 |
| 4,662,785 | A * | 5/1987 | Gibb et al. | 405/195.1 |
| 4,668,126 | A | 5/1987 | Burton | |
| 4,844,511 | A | 7/1989 | Galle et al. | |
| 5,066,048 | A | 11/1991 | Farrell | |
| 5,259,459 | A | 11/1993 | Valka | |
| 5,390,966 | A * | 2/1995 | Cox et al. | 285/124.2 |
| 5,439,323 | A * | 8/1995 | Nance | 405/195.1 |

(Continued)

FOREIGN PATENT DOCUMENTS

| | | |
|---|---|---|
| FR | 2464426 | 5/1982 |
| WO | 2013022541 | 2/2013 |

OTHER PUBLICATIONS

Invitation to Pay Additional Fees and, Where Applicable, Protest Fee for PCT Patent Application No. PCT/US2012/045984 dated Oct. 2, 2013, 6 pages.

(Continued)

*Primary Examiner* — Matthew Buck
(74) *Attorney, Agent, or Firm* — JL Salazar Law Firm

(57) ABSTRACT

A marine riser includes a plurality of central pipes assembled end to end to form a main conduit. A plurality of tension members runs the length of the main conduit. The tension members are coupled to the main conduit to support and constrain an axial motion of the main conduit.

20 Claims, 5 Drawing Sheets

(56) References Cited

U.S. PATENT DOCUMENTS

| | | | | |
|---|---|---|---|---|
| 5,540,281 | A | 7/1996 | Round | |
| 5,634,671 | A * | 6/1997 | Watkins | 285/18 |
| 5,992,893 | A * | 11/1999 | Watkins | 285/18 |
| 6,070,669 | A | 6/2000 | Radi et al. | |
| 6,330,918 | B1 | 12/2001 | Hosie et al. | |
| 6,401,825 | B1 | 6/2002 | Woodrow | |
| 6,419,277 | B1 * | 7/2002 | Reynolds | 285/123.1 |
| 6,557,637 | B1 | 5/2003 | Dore et al. | |
| 6,623,044 | B1 * | 9/2003 | Guesnon et al. | 285/124.1 |
| 6,837,311 | B1 | 1/2005 | Sele et al. | |
| 7,686,342 | B2 | 3/2010 | Jennings et al. | |
| 7,762,337 | B2 * | 7/2010 | Papon et al. | 166/345 |
| 7,913,767 | B2 * | 3/2011 | Larson et al. | 166/380 |
| 8,037,939 | B2 * | 10/2011 | Poirette et al. | 166/367 |
| 8,037,989 | B2 | 10/2011 | Neelakantan et al. | |
| 8,322,438 | B2 * | 12/2012 | Larson et al. | 166/367 |
| 8,528,647 | B2 * | 9/2013 | Guesnon et al. | 166/367 |
| 8,561,706 | B2 * | 10/2013 | Averbuch et al. | 166/338 |
| 8,616,286 | B2 * | 12/2013 | Papon et al. | 166/338 |
| 8,657,013 | B2 * | 2/2014 | Kotrla et al. | 166/367 |
| 2005/0146137 | A1 | 7/2005 | Davidson et al. | |
| 2009/0166043 | A1 | 7/2009 | Poirette et al. | |
| 2009/0212092 | A1 * | 8/2009 | Stol | 228/112.1 |
| 2010/0270025 | A1 | 10/2010 | Larson et al. | |
| 2010/0300699 | A1 | 12/2010 | Papon et al. | |
| 2010/0319925 | A1 * | 12/2010 | Papon et al. | 166/345 |
| 2010/0326671 | A1 | 12/2010 | Buytaert et al. | |
| 2011/0130966 | A1 | 6/2011 | Zhan et al. | |
| 2012/0037377 | A1 * | 2/2012 | Walker | 166/345 |
| 2012/0160508 | A1 | 6/2012 | Thommesen | |
| 2012/0312544 | A1 * | 12/2012 | Tavner et al. | 166/367 |
| 2013/0161021 | A1 * | 6/2013 | Makosey et al. | 166/345 |

OTHER PUBLICATIONS

International Search Report for PCT Patent Application No. PCT/US2012/045984 dated Sep. 20, 2013, 6 pages.

International Report on Patentability and Written Opinion for PCT Patent Application No. PCT/US2012/045984 dated Feb. 11, 2014, 10 pages.

International Search Report for PCT Application No. PCT/US2013/069390 dated Sep. 9, 2014, 5 pages.

* cited by examiner

MARINE RISER WITH SIDE TENSION MEMBERS

BACKGROUND

The present disclosure relates generally to construction of marine risers.

In offshore drilling, a marine riser is used to connect a floating rig to a seafloor. The marine riser provides a conduit through which fluid and equipment can be passed between the rig and a well drilled beneath the seafloor. The lower end of the marine riser is normally flexibly latched to a blowout preventer stack at the seafloor, whereby the marine riser is permitted to deflect angularly as the floating rig sways or drifts. The upper end of the marine riser normally includes a telescopic joint connected to the floating rig to compensate for heave of the floating rig. A system of riser tensioners located on the floating rig applies tension to the upper end of the marine riser so that the marine riser does not buckle under its own weight.

A marine riser of a desired length is made by connecting several marine riser segments together. Each riser segment includes a central pipe with a length of, for example, about 75 ft. (22.86 m). Each riser segment may also include auxiliary conduits external to the central pipe. The auxiliary conduits may include a mud boost line, choke and kill lines, and hydraulic conduits, e.g., for functions such as glycol injection, hydraulics, riser fill-up, and so on. Each pipe or conduit included in the riser segment represents a pipe connection that may be made when several riser segments are connected together to form the marine riser. Therefore, the ability to quickly make up connections between riser segments continues to be an important aspect of designing marine risers, especially as drilling moves into deeper waters, which may require that more riser segments are joined together to form the desired marine riser length.

When marine riser segments are assembled end to end, the central pipes form a main conduit. In conventional marine risers, the main conduit may be required to carry much of the tension load in the marine riser. This means that the main conduit would have to be designed to withstand the maximum expected tension load while the marine riser is in use. This tension requirement may increase as the depth of water between the floating rig and the seafloor increases. An approach when confronted with meeting higher tension requirement may be to increase the diameter and wall thickness of the central pipes. While this may yield a stronger main conduit, the marine riser also becomes heavier, which would result in greater burden on the system of riser tensioners. In many cases, adjusting the geometry of the central pipes also means that the connector geometry between riser segments has to be redesigned.

U.S. Pat. No. 6,419,277 ("Reynolds") discloses a marine riser including a plurality of riser joints connected to each other by threaded connections. Each riser joint has a threaded coupling at each end. Flanges are coupled to the riser joint by bearings, which can be ball, roller, or any other type that will enable relative rotation between the joint and the flanges. The flanges have openings for auxiliary conduits, e.g., mud boost line, choke/kill line, and hydraulic conduits. Because the flanges are coupled to the joint through the bearings, when the joint is assembled to a corresponding joint, the joint can be rotated while the flanges and the auxiliary conduits can remain rotationally fixed. This enables the joint to be connectible to other such joints using conventional threaded coupling methods. Reynolds discloses that the auxiliary conduits may be joined together using any type of connectors known in the art and specifically suggests slip-type connectors disclosed in U.S. Pat. No. 4,496,173 ("Roche et al.").

SUMMARY

According to the present disclosure, in one aspect, a marine riser includes a plurality of central pipes assembled end to end to form a main conduit. The marine riser further includes a plurality of tension members, each tension member running a length of the main conduit. The tension members are coupled to the main conduit to support and constrain an axial motion of the main conduit.

In one embodiment, each tension member includes a plurality of side pipes joined together by load-transfer pipe connections.

In one embodiment, each tension member includes a plurality of side pipes joined together by threaded pipe connections.

In one embodiment, the side pipes are drill pipes.

In one embodiment, the central pipes are assembled end to end by slip-type pipe connections.

In one embodiment, each of the tension members defines an auxiliary conduit.

In one embodiment, the main conduit comprises one or more first pipe connections and each tension member comprises one or more second pipe connections, wherein the first pipe connections are isolated from the second pipe connections.

In one embodiment, the marine riser further includes at least one buoyancy module surrounding at least a portion of each tension member and at least a portion of the main conduit.

According to the present disclosure, in another aspect, a marine riser segment includes a central pipe having central pipe connection members at its opposing ends and a plurality of side pipes circumscribing and coupled to the central pipe. Each of the side pipes has side pipe connection members at its opposing ends. The side pipe connection members are adapted to form load-transfer pipe connections with other side pipes.

In one embodiment, the side pipe connection members are threaded pipe connection members.

In one embodiment, the central pipe connection members are adapted to form slip-type pipe connections.

In one embodiment, the side pipes circumscribing the central pipe are drill pipes.

In one embodiment, the marine riser segment further includes a plurality of radial supports attached to the central pipe. Each radial support has at least one hole for receiving one of the side pipes.

In one embodiment, the radial supports arrange the side pipes in parallel to the central pipe.

In one embodiment, the marine riser segment further includes retainers for retaining the side pipes in the holes of the radial supports.

In one embodiment, the retainers permit rotary motion of the side pipes in the holes while restricting axial motion of the side pipes.

In one embodiment, the central and side pipe connection members are separated such that the central and side pipe connection members can be individually made up with other central and side pipe connection members of other central and side pipes.

In one embodiment, the marine riser segment further includes a buoyancy module in which the central pipe and side pipes are at least partially embedded.

It is to be understood that both the foregoing general description and the following detailed description are exemplary of the subject matter and are intended to provide an overview or framework for understanding the nature and character of the subject matter as it is claimed. The accompanying drawings are included to provide a further understanding of the subject matter and are incorporated in and constitute a part of this specification. The drawings illustrate various embodiments of the subject matter and together with the description serve to explain the principles and operation of the subject matter.

BRIEF DESCRIPTION OF THE DRAWINGS

The following is a description of the figures in the accompanying drawings. The figures are not necessarily to scale, and certain features and certain views of the figures may be shown exaggerated in scale or in schematic in the interest of clarity and conciseness.

DETAILED DESCRIPTION

Figure 1:
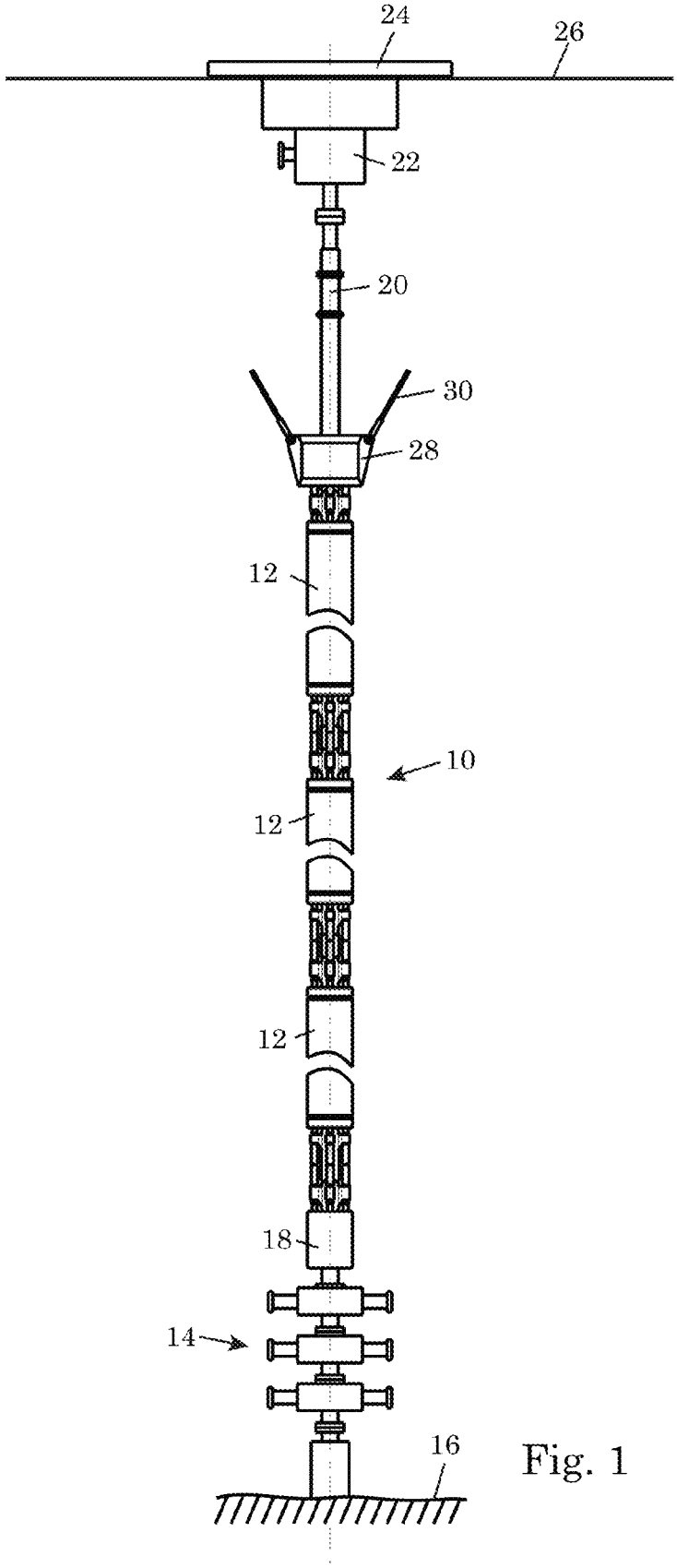
FIG. 1 shows a marine riser extending between a blowout preventer stack and a rotary table.

In the following detailed description, numerous specific details may be set forth in order to provide a thorough understanding of embodiments of the disclosure. However, it will be clear to one skilled in the art when embodiments of the disclosure may be practiced without some or all of these specific details. In other instances, well-known features or processes may not be described in detail so as not to unnecessarily obscure the disclosure. In addition, like or identical reference numerals may be used to identify common or similar elements.

FIG. 1 shows a marine riser 10 extending between a rotary table 24 on a rig floor 26 of a floating rig and a blowout preventer stack 14 on or near a seafloor 16. The marine riser 10 includes several marine riser segments 12, which are joined together to form a string. Each marine riser segment 12 may be about 70 ft. (21.34 m) long, but may generally range from about 50 ft. to 90 ft. (15.24 m to 27.43) in length. The number of marine riser segments 12 in the marine riser 10 will be determined by the depth of the water between the floating rig and the seafloor.

The lower end of the marine riser 10 is connected to the blowout preventer stack 14 by a flexible joint 18. The upper end of the marine riser 10 is connected to a telescopic joint 20, which is connected to a diverter 22 beneath the rotary table 24. The upper end of the marine riser 10 is also coupled to a tension ring 28. Tension cables 30 will connect the tension ring 28 to riser tensioners on the floating rig. The riser tensioners are devices that maintain constant tension and upward pull on the marine riser 10 as the floating rig heaves, thereby preventing the marine riser 10 from collapsing under its own weight.

Figure 2:
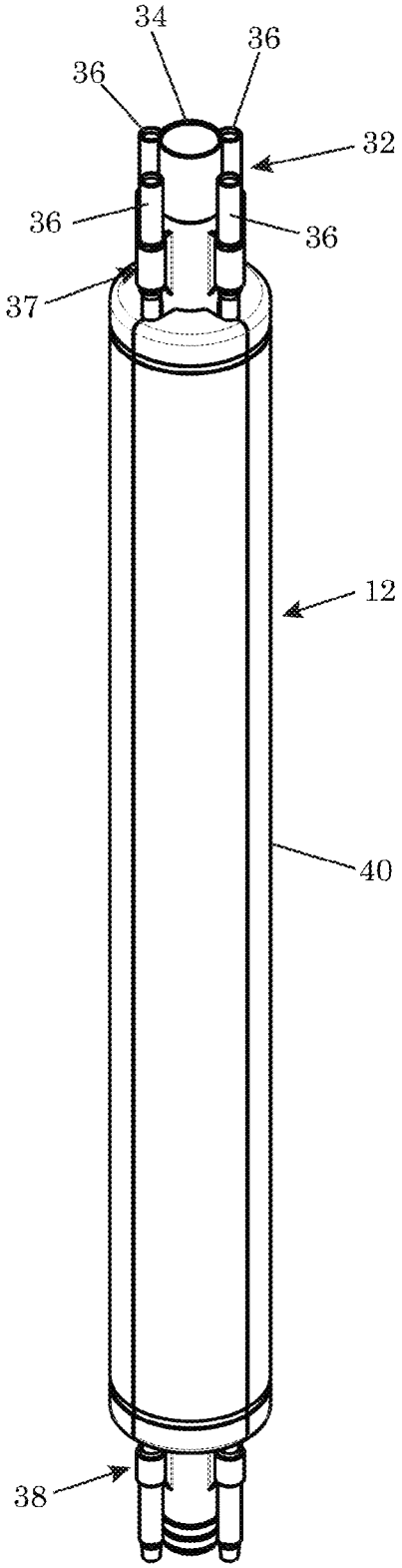
FIG. 2 shows a marine riser segment with a buoyancy module.
Figure 3:
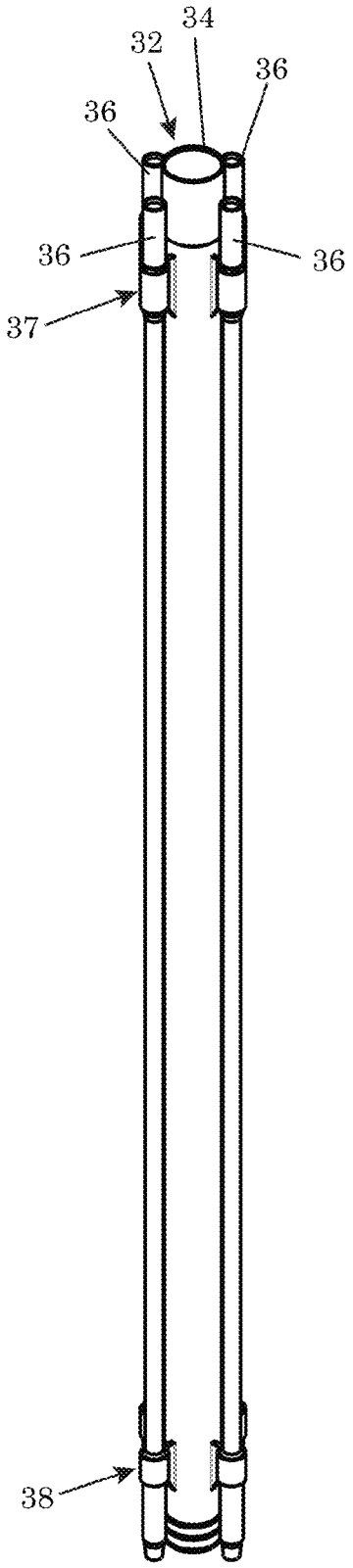
FIG. 3 shows a marine riser segment without a buoyancy module.

In FIG. 2, the marine riser segment 12 has a riser structure 32 made of a central pipe 34, a plurality of side pipes 36 circumscribing the central pipe 34, and side pipe support structures 37, 38 coupled to the central pipe 34. In one embodiment, the riser structure 32 is contained substantially within a buoyancy module 40. The ends of the riser structure 32 not contained within the buoyancy module 40 include elements for making connections between marine riser segments. The buoyancy module 40 may be sectional bodies clamped around the riser structure 32 or may be a whole body molded around the riser structure 32. The buoyancy module 40 may fill any external voids, i.e., spaces between the tubes 34, 36, in the riser structure 32. The buoyancy module 40 is made of buoyant material such as foam. The buoyancy module 40 will reduce the burden on the riser tensioners that maintain an upward pull on the marine riser 10 (in FIG. 1). In some embodiments, some of the marine riser segments in the marine riser 10 may not have buoyancy modules. FIG. 3 shows the riser structure 32 without a buoyancy module for illustration purposes.

Figure 4:
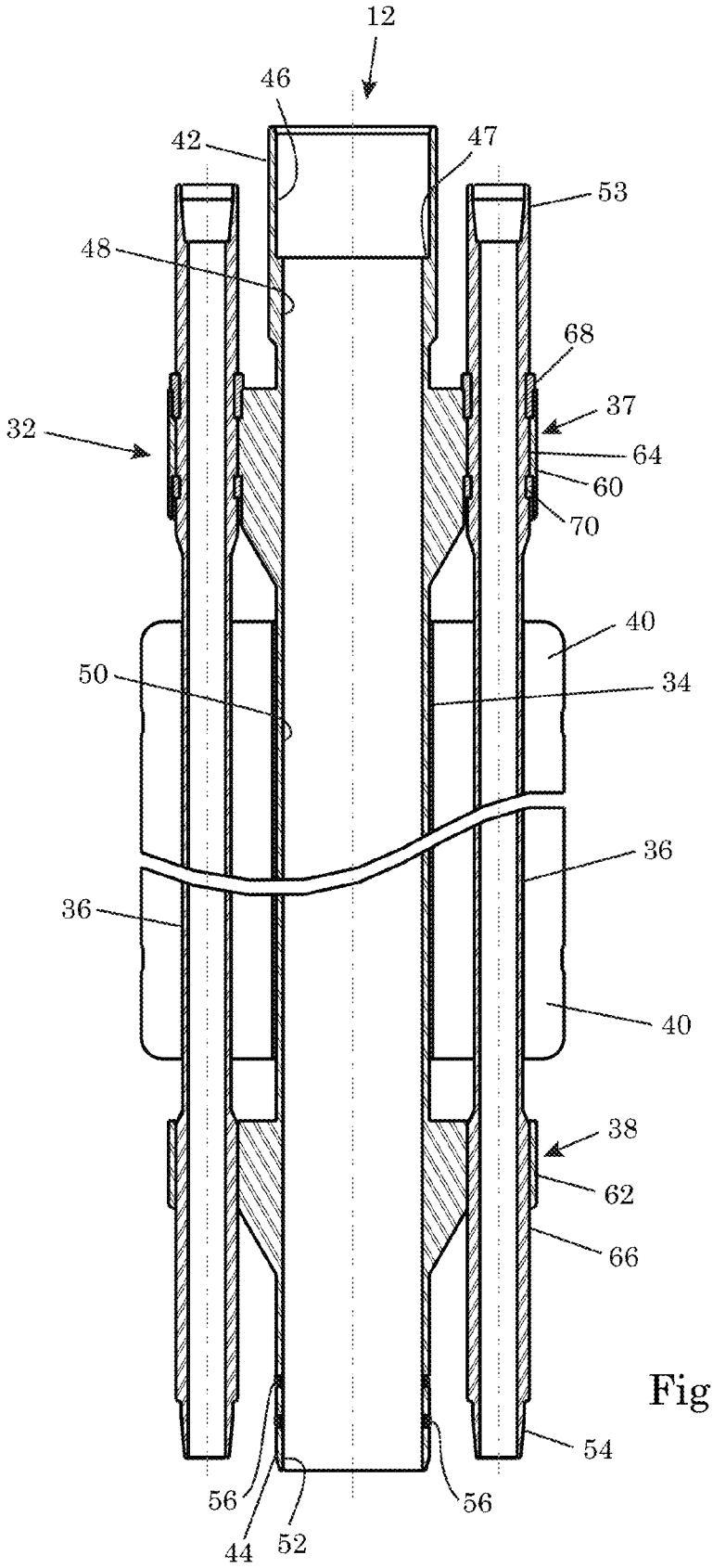
FIG. 4 is a cross-section of a marine riser segment.

The central pipe 34 can be coupled to central pipes of other riser structures by any type of pipe connections known in the art. Preferably, the type of pipe connection selected will be one that can be made up quickly. The elements needed to form the pipe connections may be attached to or integrally formed with the distal ends of the central pipe. FIG. 4 shows the central pipe 34 having a female pipe connection member 42 at one end and a male pipe connection member 44 at another end. In FIG. 4, the female and male pipe connection members 42, 44 are configured to form slip-type pipe connections with other central pipes. In alternate embodiments, the female and male pipe connection members 42, 44 may be configured to form other types of pipe connections besides slip-type pipe connections.

In FIG. 4, the female pipe connection member 42 has a socket 46 for receiving a male pipe connection member of another central pipe. Below the socket 46 is a bore 48 that is aligned and connected with the bore 50 of the central pipe 34. The diameter of the socket 46 is larger than the diameter of the bore 48 thereby forming a shoulder 47. In some embodiments, the shoulder 47 limits insertion of a male pipe connection member into the female pipe connection member 42 and prevents the male pipe connection member from passing into the bore 50 of the central pipe 34. The diameter of the bore 48 of the female pipe connection member 42 may be the same as the diameter of the bore 50 of the central pipe 34. The outer diameter of the female pipe connection member 42 will generally be larger than that of the central pipe 34.

The male pipe connection member 44 is a tube having a bore 52 aligned and connected with the bore 50 of the central pipe 34. The male connection member 44 may simply be a section of the central pipe 34 having the same inner and outer diameters as the central pipe 34. The outer diameter of the male pipe connection member 44 will generally be selected such that the male pipe connection member 44 may be received within the socket of the female pipe connection member of another central pipe without traversing into the bore of the other central pipe. In other words, in some embodiments, the outer diameter of the male pipe connection member 44 is less than the inner diameter of the socket 46 but greater than the inner diameter of the bore 50. The male pipe connection member 44 may carry one or more seals 56 for sealing against the wall of the socket of a female pipe connection member on the central pipe of another marine riser segment. Alternatively, the seals 56 could be located on the inner wall of the socket 46 of the female pipe connection member 42.

Figure 5:
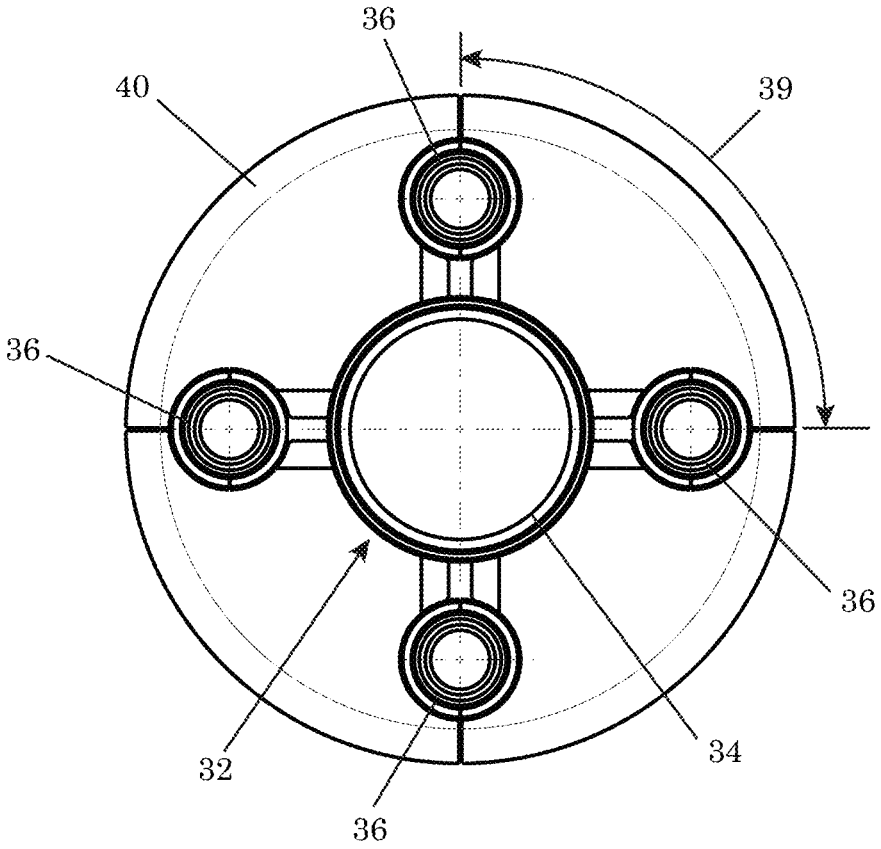
FIG. 5 is a top view of a marine riser segment.

As previously mentioned, the riser structure 32 includes a plurality of side pipes 36. In some embodiments, as best illustrated in FIG. 5, the side pipes 36 are disposed about, or circumscribe, the central pipe 34 such that their axial centerlines are equidistant from the axial centerline of the central pipe 34. In other embodiments, the side pipes 36 may not be equidistant from the central pipe 34. In some embodiments, the circumferential spacings (see 39 in FIG. 5) between the side pipes 36 are substantially equal. In other embodiments, the circumferential spacings may not be equal. Normally, the side pipes 36 will have substantially the same lengths. The side pipes 36 may have the same weight or may have different weights due to different wall thicknesses or material properties. In the latter case, it may be desirable to unevenly space the side pipes 36 around the central pipe 34 so that the weight distribution of the riser segment is more balanced, which may result in unequal circumferential spacings as mentioned above. In some embodiments, the side pipes 36 may be arranged in groups or clusters, with circumferential spacings between the groups or clusters that may or may not be substantially equal.

Returning to FIG. 4, each side pipe 36 is a tension member, i.e., can carry tension load. A tension member of desired length can be formed by joining several side pipes 36 together using load-transfer pipe connections. A load-transfer pipe connection is a pipe connection that when formed between two pipes (or tubes) enables axial loads to be directly transferred between the two pipes. There are various forms of load-transfer pipe connections in the art, and any of these may be used in joining the side pipes to form a tension member of desired length. Specific examples include, but are not limited to, bolted flanged connections, threaded connections, dog and slot connections, shrink-fit connections, and hub and clamp connections. Preferably, the load-transfer pipe connections are not permanent connections such as welds so that the side pipes can be assembled and disassembled as needed.

Each side pipe 36 has a female pipe connection member 53 at one end and a male pipe connection member 54 at another end. The female and male pipe connection members 53, 54 are configured to form load-transfer pipe connections with other side pipes of other riser structures. In FIG. 4, the female and male pipe connection members 53, 54 are particularly configured to form threaded pipe connections, which are examples of load-transfer pipe connections. In alternate embodiments, the female and male pipe connection members 53, 54 could be configured to form other types of load-transfer pipe connections. For the embodiment shown in FIG. 4, the side pipes could be drill pipes, with the pins and boxes of the drill pipes functioning as the female and male pipe connection members 53, 54.

The side pipes 36 are arranged in parallel, or substantially parallel, to the central pipe 34 by the support structures 37, 38. In FIG. 4, the support structure 37 includes a plurality of radial supports 60 arranged near the upper end of the riser structure 32, e.g., below the female pipe connection member 42. Similarly, the support structure 38 includes a plurality of radial supports 62 arranged near the lower end of the riser structure 32, e.g., above the male pipe connection member 44. In one embodiment, the radial supports 60, 62 are attached to the central pipe 34 using any suitable means. The arrangement of the radial supports 60, 62 is such that each radial support 60 is aligned (in a direction along the length of the central pipe 34) with one of the radial supports 62. In alternate embodiments, the radial supports 60 may be sections of a single flange. Similarly, the radial supports 62 may be sections of a single flange.

Each radial support 60, 62 has at least one hole 64, 66. The holes 64, 66 in each aligned set of radial supports 60, 62 are aligned to receive a side pipe 36. When the side pipes 36 are disposed in the aligned holes 64, 66, the side pipes 36 are parallel, or substantially parallel, to the central pipe 34. The holes 64, 66 may be large enough to accommodate the largest diameters of the side pipes 36 that will be used in the riser structure 32. Split collars 68, 70 or other similar retaining devices are used to retain the side pipes 36 on the radial supports 60 or to prevent the side pipes 36 from falling through the holes 64, 66. In one embodiment, the split collars or retainers 68, 70 permit rotational motion of the side pipes 36 in the holes 64, 66 while restricting axial motion of the side pipes 36. The axial motion to be restricted is in a direction parallel to, or substantially parallel to, the axial axis of the central pipe 34.

While the side pipes 36 are retained on the radial supports 60, 62, the side pipe connection members 53 are separated from each other and also from the central pipe connection member 42. Similarly, the side pipe connection members 54 are separated from each other and also from the central pipe connection member 44. This makes it possible for the central and side pipe connection members to be individually made up with other pipe connection members, e.g., while connecting two riser structures. Also, the side pipe connection members 53, 54 are rotatable relative to the radial supports 60, 62 so that the method of making up side pipe connections individually can involve rotation of the side pipe connection members.

The central pipe 34 may be made of a ductile material, such as steel or aluminum, or of a composite material. The side pipes 36, being tension members, are made of a ductile material such as steel or aluminum. The pipe connection members of the central pipe 34 and of the side pipes 36 may be made of the same material as their respective pipes and may be reinforced with hardened material. The radial supports 60, 62 of the support structures 37, 38 may be made of the same material as the central pipe 34.

Figure 6:
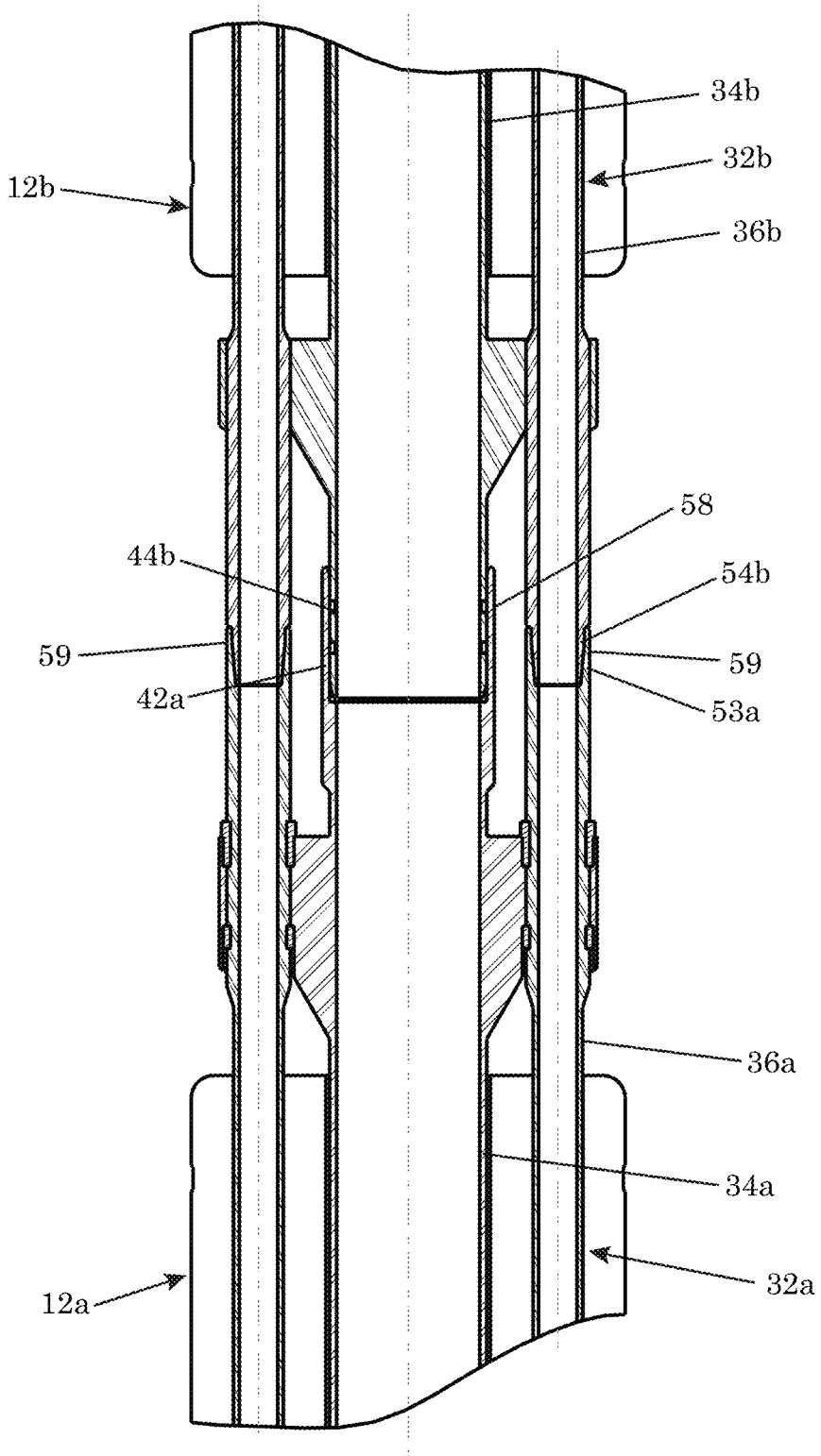
FIG. 6 shows a connection between two marine riser segments.

FIG. 6 shows two riser structures 32*a*, 32*b* of marine riser segments 12*a*, 12*b* joined together. The pipe connection members 44*b*, 42*a* of the central pipes 34*b*, 34*a* mate to form a central pipe connection 58, and the pipe connection members 54*b*, 53*a* of the side pipes 36*b*, 36*a* mate to form the side pipe connections 59. The central pipe connection 58 may be any type of pipe connection, although a slip-type pipe connection is shown in FIG. 6. The side pipe connections 59 may be any type of load-transfer connections, although threaded pipe connections as shown in FIG. 6. To join the riser structures 32*a*, 32*b*, the riser structure 32*b* is positioned on the riser structure 32*a* such that the central pipes 34*b*, 34*a* are aligned and each side pipe 36*b* is aligned with one of the side pipes 36*a*. The side pipe connections 59 are made up by rotating the side pipes 36*b* relative to the side pipes 32*a*. The pipe connection member 44*b* simply slips into the pipe connection member 42*a* to form the central pipe connection 58.

The design of each of the riser structures 32*a*, 32*b* is such that each of the side pipe connections 59 and central pipe connection 58 can be made up individually. This is possible because the pipe connection members responsible for making up the pipe connections 58, 59 are separated from each other. This also means that the resulting side pipe connections 59 and central pipe connections 58 are separated from each other. Separation of the central pipe connections 59 from the central pipe connection 58 will prevent direct transfer of axial load from the side pipes 36*a*, 36*b* to the central pipes 34*a*, 34*b* through the pipe connections 58, 59.

Using the central and side pipe connections as described above, a plurality of marine riser segments can be assembled end to end to form a marine riser, such as marine riser 10 in FIG. 1. In the marine riser, the central pipes will be linked together with any suitable pipe connections to form a main conduit running the length of the marine riser, and the side pipes will be linked together with any suitable load-transfer pipe connections to form a plurality of tension members, each of which will run the length of the main conduit. Each tension member formed by the connected side pipes will provide an auxiliary conduit that can be used as a choke/kill line or for another function, such as glycol injection, hydraulics, or riser fill-up.

The tension members formed by the connected side pipes are coupled to the main conduit formed by the connected central pipes to support and constrain axial motion of the conduit. The axial motion mentioned here is along an axial axis of the main conduit. Use of the connected side pipes as tension members greatly relaxes the tension requirement for the main conduit. For example, slip-type pipe connections can be used between the connected central pipes that form the main conduit, where the constraining action of the tension members provided by the connected side pipes will prevent the central pipes from being pulled apart by tensile loads applied to the marine riser. The coupling of the tension members to the central pipes is provided by the combination of the radial supports (see, e.g., 60, 62 in FIG. 4) and the retaining devices (see, e.g., 68, 70 in FIG. 4) described above or by other equivalent structures.

Each marine riser segment will have at least two tension members, where each tension member will be made of a plurality of side pipes joined together by load-transfer pipe connections. Each marine riser segment may have three or more tension members. Ultimately, the number of tension members in each riser segment will depend on the required tension to maintain stability of the marine riser in the operating environment. The required tension will depend on the weight of the marine riser, the buoyancy of the marine riser, and the external and internal forces acting on the marine riser, e.g., forces from the ocean waves and currents and forces from fluids flowing through the marine riser.

The system described above moves the load-carrying burden substantially from the central pipes to the side pipes. As described above, the side pipes are connected by load-transfer pipe connections, which allow them to act as tension members that can carry substantial tensile load. Removing the load-carrying burden from the central pipes allows the central pipes to be optimized for the purpose of acting as a main conduit between the floating rig and the subsea floor. The side pipes can then be optimized for the tension requirement of the marine riser. Meeting a new tension requirement can be as simple as using more or less side pipes or varying the sizes of the side pipes, while leaving the central pipes unchanged. This can allow for quick deployment of marine risers that have desired specifications.

While the subject matter has been described with respect to a limited number of embodiments, those skilled in the art, having benefit of this disclosure, will appreciate that other embodiments can be devised which do not depart from the scope of the subject matter as disclosed herein. Accordingly, the scope of the subject matter should be limited only by the attached claims.

The invention claimed is:

1. A marine riser comprising:

a plurality of central pipes assembled end to end to form a main conduit, the plurality of central pipes matingly connected for sliding engagement therebetween after assembly; and a plurality of tension members each running a length of the main conduit, the plurality of tension members being coupled to the main conduit to support and constrain an axial motion of the main conduit.

2. The marine riser of claim 1, wherein each of the plurality of tension members comprises a plurality of side pipes joined together by load-transfer pipe connections.

3. The marine riser of claim 1, wherein each of the plurality of tension members comprises a plurality of side pipes joined together by threaded pipe connections.

4. The marine riser of claim 2, wherein the plurality of side pipes are drill pipes.

5. The marine riser of claim 1, wherein the plurality of tension members define an auxiliary conduit.

6. The marine riser of claim 1, wherein the main conduit comprises one or more first pipe connections and each of the plurality of tension members comprises one or more second pipe connections, and wherein the first pipe connections are isolated from the second pipe connections.

7. The marine riser of claim 1, further comprising at least one buoyancy module surrounding at least a portion of the plurality of tension members and at least a portion of the main conduit.

8. The marine riser of claim 1, wherein the plurality of central pipes each have a male end and a corresponding female end, the female end matingly engageable with the male end of an adjacent one of the plurality of central pipes to permit slidable engagement therebetween.

9. The marine riser of claim 1, further comprising side pipe support structures coupled to the plurality of central pipes and the plurality of tension members.

10. The marine riser of claim 9, further comprising retaining devices positionable in the side pipe support structures to retain the plurality of tension members therein.

11. The marine riser of claim 10, wherein the retaining devices comprise split collars positionable in the side support structures.

12. A marine riser segment, comprising:

a central pipe having central pipe connection members at opposing ends thereof, each of the central pipe connection members having ends matingly connectable to another central pipe for sliding engagement therebetween after assembly; and a plurality of side pipes circumscribing and coupled to the central pipe, each of the plurality of side pipes having side pipe connection members at opposing ends thereof to form load-transfer pipe connections with other side pipes.

13. The marine riser segment of claim 12, wherein the side pipe connection members are threaded pipe connection members.

14. The marine riser segment of claim 12, wherein the plurality of side pipes are drill pipes.

15. The marine riser segment of claim 12, wherein radial supports are attached to the central pipe, each of the radial supports having at least one hole for receiving one of the plurality of side pipes.

16. The marine riser segment of claim 15, wherein the radial supports arrange the plurality of side pipes in parallel to the central pipe.

17. The marine riser segment of claim 15, further comprising retainers for retaining the plurality of side pipes in the holes of the radial supports.

18. The marine riser segment of claim 17, wherein the retainers permit rotary motion of the plurality of side pipes in the holes while restricting axial motion of the plurality of side pipes.

19. The marine riser segment of claim 12, wherein the central and the side pipe connection members are separated such that the central and the side pipe connection members can be individually made up with other pipe connection members of other central pipes and the other side pipes.

20. The marine riser segment of claim 12, further comprising a buoyancy module in which the plurality of side pipes and the central pipe are at least partially embedded.

* * * * *